United States Patent [19]

Beck et al.

[11] Patent Number: 4,877,609

[45] Date of Patent: Oct. 31, 1989

[54] COMBINATION FOOD SERVER AND CONTAINER LID SUPPORT

[76] Inventors: Dilman A. Beck; Susan E. Beck, both of 1486 S. Lee Ct., Lakewood, Colo. 80226

[21] Appl. No.: 168,145

[22] Filed: Mar. 15, 1988

[51] Int. Cl.[4] ..... B65D 85/36

[52] U.S. Cl. ..... 426/87; D7/102; D7/106; 206/525; 206/542; 206/551; 229/906; 294/7; 426/115; 426/124; 426/128; 426/394; 30/124

[58] Field of Search ..... 206/525, 541, 542, 545, 206/549, 550, 551; 294/7, 8; 229/902, 906, 904; 426/106, 112, 115, 124, 128, 132, 87; D7/102, 106, 99, 142; 30/114, 124, 315

[56] References Cited

U.S. PATENT DOCUMENTS

| | | | |
|---|---|---|---|
| 1,746,614 | 2/1930 | Sibbald | 30/114 |
| 2,294,569 | 9/1942 | Petersen | 294/7 |
| 2,430,566 | 11/1947 | Harviss | 426/87 |
| 2,446,629 | 8/1948 | Brown et al. | 206/551 |
| 2,896,834 | 7/1959 | Frankenstein | 229/906 X |
| 3,229,316 | 1/1966 | Matheson | D7/99 X |
| 3,771,713 | 11/1973 | Davidson | 206/551 X |
| 3,877,143 | 4/1975 | Montesi | 294/7 X |
| 4,423,551 | 1/1984 | Chiniela et al. | 30/124 X |
| 4,498,586 | 2/1985 | Vitale | 206/525 |
| 4,700,843 | 10/1987 | Cohen | 206/525 X |

OTHER PUBLICATIONS

Spatula, Author Unknown, Evidenced by Declaration of Dilman A. Beck, Jul. 6, 1989.

*Primary Examiner*—Bryon P. Geliman

*Attorney, Agent, or Firm*—Gregory W. O'Connor; Edna M. O'Connor

[57] ABSTRACT

Single use supports comprising small, plastic three legged stools are known as aid in preventing the cover portions of pizza containers from collapsing onto the pizza being transported or stored in the container. These devices have only limited utility. Proposed herein is a combination serving utensil and container support. This device has a server portion sized and shaped to serve a typical serving slice of pizza, and an upstanding portion which has a vertical dimension which, when the server portion is placed between the pizza and the base portion of the container, approximates the height of the pizza container. The device also includes a handle portion preferably attached to the upper end of the upstanding portion. This handle portion extends substantially parallel to but offset from the server portion and has an upper surface which may include advertising indicia thereon.

18 Claims, 1 Drawing Sheet

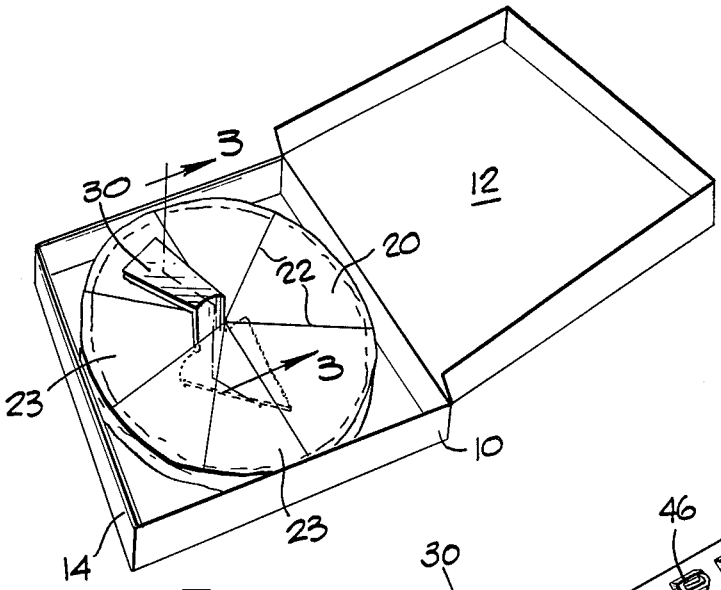
FIG. 1
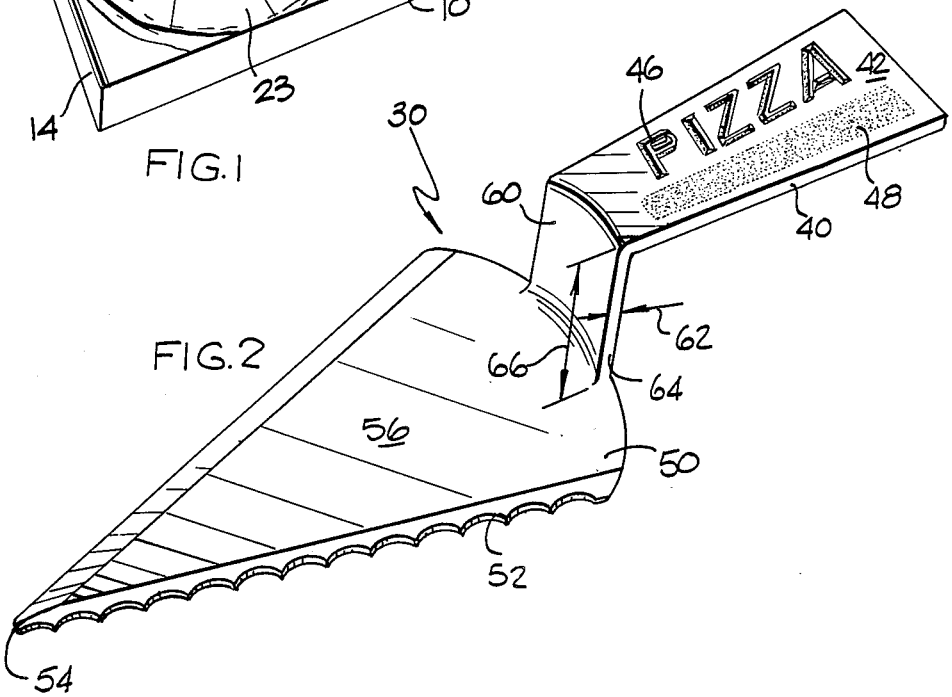
FIG. 2
FIG. 3
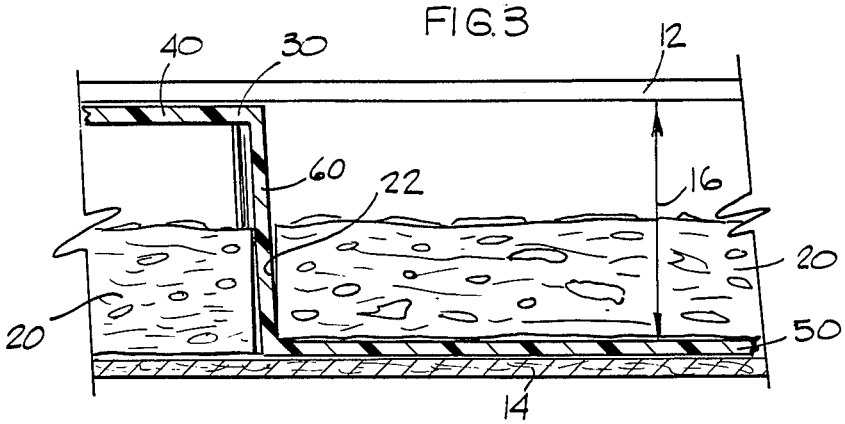

COMBINATION FOOD SERVER AND CONTAINER LID SUPPORT

BACKGROUND OF THE INVENTION

The present invention relates to a food product container in combination with a food product container support. The food product container support provides support for the cover portion of the food product container. One such prior art support is shown in the U.S. Pat. No. 4,498,586. This patent shows a cover support having spaced vertical legs connected to an upper surface having a spoke-like arrangement. The cover support of the prior art patent is designed to have minimal volume in the pizza container.

BRIEF SUMMARY OF THE INVENTION

It is the object of the instant invention to provide a cover support for a food container, in particular a pizza container, that is also a pizza server. Unlike the prior art, the subject invention is not designed to have minimal volume, but rather to have a dual function. Accordingly the subject invention provides a pizza container support having a horizontally extending server portion. This server portion is designed to be positioned under the pizza. The pizza container support further contains an upstanding portion having a dimension generally perpendicular to the server portion adequate to support the cover of the pizza container when the server portion is inserted between the pizza and the pizza container base portion on which it rests.

The present invention also encompasses a method of packaging a relatively flat food product for transport or storage comprising providing a container, the container having a base portion, a cover portion, and a space adequate to contain the food product therebetween. The food product is placed on the base portion in the space between the cover portion and the base portion. A container support, which includes a server portion having a shape and size adequate for separating and serving slices or portions of the food product, and an upstanding portion having a vertical dimension approximately equal to the height of the space between the cover portion and the base portion of the container, is placed between the cover portion and the base portion. Thus, a central region of the cover portion is supported and prevented from collapsing onto the top of the food product during ordinary transport or storage.

BRIEF DESCRIPTION OF THE DRAWINGS

FIG. 1 is a perspective view of the pizza server/container support of the present invention in use.

FIG. 2 is a perspective view of the pizza server/container support of FIG. 1.

FIG. 3 is a sectional view along line 3—3 of FIG. 1.

DETAILED DESCRIPTION OF THE PREFERRED EMBODIMENT

Referring to FIG. 1, a typical pizza container is shown comprising a corrugated paper container having a base portion 14 and a cover portion 12 having overall dimensions adequate to hold a pizza pie or other relatively flat food product. The inside height (16 in FIG. 3) is adequate to not only contain the pizza but to provide at least some space above the pizza to accommodate the varying thickness of the pizza and its toppings and any slight flexing of the cover 12 towards the top of the pizza and thus prevent at least crushing contact between the cover and the upper surface of the pizza.

The pizza 20, as is typical in the take out or frozen pizza industry, has several radial cuts 22 which form serving size pieces 23 having the characteristic wedge shape.

FIG. 2 shows the preferred embodiment of the invention in greater detail. Pizza server 30 includes a handle portion 40. Ideally the handle portion will be about 3" long and about 1" wide. These dimensions can be varied though the handle portion 40 should be dimensioned so as to comfortably accommodate the server's hand. Handle portion 40 further includes an upper surface 42 arranged substantially parallel to but vertically offset from the serving portion of the pizza server. Upper portion 42 may include advertizing slogans or names done in intaglio or raised lettering 46. The upper surface 42 may further include a textured portions 48 in addition to or as an alternative to raised or indented indicia. The handle portion could also be smooth to receive an adhesive label or screen printing.

Pizza server 30 further includes a server portion 50. Ideally the server portion 50 will be about 6" in length, as this size is preferable to cut and serve 8" to 14" pizza. It is understood, however, that this dimension can vary depending on the size of the pizza or food product to be served. Server portion 50 includes an upper surface 56 which may include advertising, much like surface 42. Serrated edge 52 is utilized to finish cutting any partial radial cuts in the pizza. The opposite edge 53 has a fairly sharp edge to sever any remaining strings of cheese of the pizza. A pointed front end 54 is provided to aid in inserting the server portion between the pizza 20 and base portion 14. While the server portion is shown as being wedge shaped, other shapes (rectangular, square, etc) more convenient for serving other types of food products maybe used without departing from the invention.

Between the handle portion 40 and server portion 50 there is provided an upstanding portion 60. The server portion 50 is substantially perpendicular to upstanding portion 60 though the upstanding portion may extend upward from the server portion at about 5 degrees from the vertical. This slight variance is to facilitate injection molding. The vertical dimension 66 of upstanding portion 60 is of sufficient height to support the cover 12 of the food container. Typically, this height would be between ½" to 2½". In the case of a pizza container made from a bag or the like this height could be greater, at least near the center of the container where it is supported by the disclosed device. The upstanding portion 60 includes a relatively narrow dimension 62 so that the upstanding portion can be inserted easily through cuts 22 with minimal displacement of the slices or breaking the crust adjacent the point of insertion.

To use the subject invention the pizza is prepared and cut into serving size portions in the normal manner. The thus cut pizza is placed into a container for delivery to or pick-up by the customer. The point 54 of the subject invention is inserted through a radial cut and the server portion is pushed underneath a portion of the pizza, preferably near the center of the pizza so as to place the device near the center of the container cover 12 when it is closed. Alternatively, the server portion could be slipped under the pizza from the side along one of the cuts.

It has been found the the subject invention is remarkably effective in supporting the container cover from collapsing onto the pizza during normal transport and storage. The weight of the pizza under which the serving portion rests opposes tipping of the handle and upstanding portion when they are resisting a downward force on the cover portion. The handle portion, being generally parallel to the serving portion tends to prevent or delay the tendency of this downward force from prying up the server portion. Indeed, most of the downward force is resisted by the handle at a point close to the upstanding portion, thus the moment arm through which the downward force would act to pry up on the server portion is small in contrast with the counteracting moment provided by the weight of the pizza on the server portion.

While the subject invention has been illustrated by its use with pizza storage and delivery, its benefits could also be used with other food products which are transported or stored in containers having cover portions which may tend to collapse on to the upper surface of the food product. Cakes or cake like confections having frosted or other easily damaged upper surfaces, or fried or baked foods having sauces or delicate coatings which could stick to box lids or wrappings could benefit from the method and constructions taught by the subject invention.

We claim:

1. In combination with a container for food product having a food product therein, the food product container including a base portion and a cover portion defining a space therebetween, a food product container support, said food product container support comprising a generally horizontally extending server portion positioned underneath a portion of said food product.

an upstanding portion connected to said server portion and extending through said food product having a dimension generally perpendicular to the server portion adequate to support the cover portion of the food product container to prevent the cover portion from collapsing onto the food product therein when the cover portion is subjected to a downward force such as that normally occurring during transport of the food product in the food product container.

2. A food product container support as in claim 1 wherein the upstanding portion has an upper end, and further including a handle portion supported on the upper end of the upstanding portion.

3. A food product container support as in claim 2 wherein the handle portion has an upwardly facing surface which is broad relative to its vertical dimension for displaying information thereon.

4. A food product container support as in claim 3 wherein the upper surface of the handle portion includes advertising thereon.

5. A food product container support as in claim 1 wherein the upstanding portion interconnects the serving portion and the handle portion.

6. A food product container support as in claim 1 wherein the upstanding portion has a major dimension which is substantially vertical.

7. A food product container support as in claim 6 wherein the food product is arranged in slices and the upstanding portion has a width and has a minor dimension which is narrow relative to its width and the major dimension, whereby when the server portion is inserted between said slices of food product so that the server portion is positioned between the food product and the base portion, the upstanding portion projects between said slices of food product and the weight of the food product helps hold the upstanding portion erect in the space between the cover portion and the base portion.

8. A food product container support as in claim 7 wherein the width of the upstanding portion is perpendicular to the longest dimension of the server portion.

9. A food product container support as in claim 6 wherein the upstanding portion extends upward from the server portion at about 5 degrees from the vertical.

10. A food product container support as in claim 1 wherein the server portion includes a pointed end for inserting the serving portion between the food product and the base portion.

11. A food product container support as in claim 1 wherein the server portion includes a straight edge, the straight edge includes serrations to aid in cutting the food product.

12. A food product container support as in claim 1 wherein the food product is a pizza.

13. A method of packaging a relatively flat food product for transport or storage comprising providing a container, the container having a base portion, a cover portion, and a space adequate to contain the food product therebetween, providing a container support having a server portion and an upstanding portion, placing the food product on the base portion in the space between the cover portion and the base portion, inserting said container support through said food product to place said server portion underneath a portion of said food product and between the cover portion and the base portion whereby a central region of the cover portion is supported thereby and prevented from collapsing onto the top of the food product during ordinary transport or storage, said server portion having a shape and size adequate for serving portions of the food product, and said upstanding portion having a vertical dimension approximately equal to the height of the space between the cover portion and the base portion of the container.

14. A method as set forth in claim 13 further including the step of cutting the food product into slices and inserting the server portion of the support between the thus formed slices to place the upstanding portion between the slices and to place a portion of the food product on the upper surface of the server portion, whereby the weight of the food product helps to hold the upstanding portion upright in the space.

15. A method as set forth in claim 14 wherein the support provided therein further includes a handle portion connected at the upper end of the upstanding portion, the step of supporting the cover portion comprises supporting the central region with the handle portion.

16. A method as set forth is claim 15 further including the step of displaying advertising on the upper surface of the handle portion.

17. In combination with a container for food product having a food product therein, the container including a base portion and a cover portion defining a space therebetween, a food product container support comprising a generally horizontally extending server portion, an upstanding portion having a dimension generally perpendicular to the server portion adequate to support the cover portion of the food product container to prevent the cover portion from collapsing onto the food product therein when the cover portion is subjected to a downward force such as that normally occurring during transport of the food product in the food product container, said upstanding portion has a major dimension which is substantially vertical, the food product is arranged in slices and the upstanding portion has a width and has a minor dimension which is narrow relative to its width and the major dimension, whereby when the server portion is inserted between slices of food product so that the server portion is positioned between the food product and the base portion, the upstanding portion projects between slices of food product and the weight of the food product helps hold the upstanding portion erect in the space between the cover portion and the base portion.

18. A method of packaging a relatively flat food product for transport or storage comprising providing a container, the container having a base portion, a cover portion, and a space adequate to contain the food product therebetween, placing the food product on the base portion in the space between the cover portion and the base portion, placing a container support between the cover portion and the base portion whereby a central region of the cover portion is supported thereby and prevented from collapsing onto the top of the food product during ordinary transport or storage, the container support includes a server portion having a shape and size adequate for serving portions of the food product, and an upstanding portion having a vertical dimension approximately equal to the height of the space between the cover portion and the base portion of the container, and cutting the food product into slices and inserting the server portion of the support between the thus formed slices to place the upstanding portion between the slices and to place a portion of the food product on the upper surface of the server portion, whereby the weight of the food product helps to hold the upstanding portion upright in the space.

* * * * *